US006622629B2

(12) United States Patent
Hodge et al.

(10) Patent No.: US 6,622,629 B2
(45) Date of Patent: Sep. 23, 2003

(54) SUBMUNITION FUZING AND SELF-DESTRUCT USING MEMS ARM FIRE AND SAFE AND ARM DEVICES

(75) Inventors: Kathleen F. Hodge, Lakewood, CA (US); David K. Hoffmaster, Long Beach, CA (US); William W. Mogan, Rochester, MN (US); Marion E. Fines, Mesa, AZ (US); Daniel V. Haun, Chandler, AZ (US)

(73) Assignee: Northrop Grumman Corporation, Redondo Beach, CA (US)

( * ) Notice: Subject to any disclaimer, the term of this patent is extended or adjusted under 35 U.S.C. 154(b) by 0 days.

(21) Appl. No.: 09/982,158

(22) Filed: Oct. 17, 2001

(65) Prior Publication Data

US 2003/0070571 A1 Apr. 17, 2003

(51) Int. Cl.[7] ..... F23Q 21/00; F23Q 7/02; F42C 15/26; F42C 15/34; F42C 15/40

(52) U.S. Cl. ..... 102/235; 102/215; 102/232; 102/254; 102/262

(58) Field of Search ..... 102/215, 232, 102/235, 254, 262

(56) References Cited

U.S. PATENT DOCUMENTS

| | | | | |
|---|---|---|---|---|
| 5,705,766 A | * | 1/1998 | Farace et al. | 102/215 |
| 6,131,385 A | | 10/2000 | Lewis, Jr. et al. | 60/203.1 |
| 6,167,809 B1 | * | 1/2001 | Robinson et al. | 102/235 |
| 6,314,887 B1 | * | 11/2001 | Robinson | 102/262 |
| 6,401,621 B1 | * | 6/2002 | Davis et al. | 102/232 |
| 6,431,071 B1 | * | 8/2002 | Hodge et al. | 102/254 |

* cited by examiner

*Primary Examiner*—Michael J. Carone
*Assistant Examiner*—H. A. Blackner
(74) *Attorney, Agent, or Firm*—Ronald M. Goldman

(57) ABSTRACT

A fuze for a submunition is miniaturized in size by forming the fuze of a micro-electromechanical systems ("MEMS") velocity sensor (38, 32, 34 and 36), a MEMs shock detector (31), a DC power supply (30) and one of the MEMs arm-fire device (2, FIG. 1) or MEMs safe and arm device (2, FIG. 5). Multiple fuzes may be incorporated in a fuze to ensure detonation of the explosive charge, should one fuze fail. A millimeter-microwave ("MMW") receiver-decoder may be included to permit remote detonation on command from a remote transmitter (52) and/or a microprocessor (54) may be included to time the detonation to the physical characteristics of the target.

8 Claims, 5 Drawing Sheets

SUBMUNITION FUZING AND SELF-DESTRUCT USING MEMS ARM FIRE AND SAFE AND ARM DEVICES

REFERENCE TO RELATED APPLICATIONS

Reference is made to the copending U.S. patent application, Ser. No. 09/665,230, filed Sep. 18, 2000, entitled MEMS Arm Fire and Safe and Arm Devices, and now U.S. Pat. No. 6,431,071 B1, granted Aug. 13, 2002 assigned in part to the assignee of the present invention, the disclosure of which is incorporated herein by reference.

FIELD OF THE INVENTION

This invention relates to fuzes for submunitions, and, more particularly, to a fuze structure that improves the reliability of operation, safety and effectiveness of military grenades and other explosive devices.

BACKGROUND

Submunitions are weapons of war. Examples include anti-personnel land mines, shoulder fired missiles, warheads, bomblets, anti-armor devices, blast fragmenting devices and grenades, some of which are carried by a carrier and are expelled as the carrier approaches the target. Of the foregoing submunitions, the grenade, which is used by artillery projectiles (shells), multiple-launch rocket systems, and extended range mortars, is the smallest in size. That small size imposes a significant physical constraint on the size of an installed fuze, and, indirectly, on the effectiveness and reliability of the fuze.

Consider the operation of the present grenade fuze, which, typically, detonates the grenade on impact through use of a stab detonator. Propelled from a grenade carrier, the grenade spins at a high RPM while traveling forward at a high velocity. A nylon ribbon is extended from the grenade, which orients the grenade with respect to the ground. An end of that ribbon is attached to a threaded firing pin inside the grenade. As the grenade falls, the drag of the ribbon to the rotation of the grenade produces a relative rotational force between the grenade and ribbon.

That rotational force turns the threaded firing pin out of a threaded socket in a slider, disengaging the tip of the firing pin from the slider and unthreading the firing pin into an inertial weight. Released from the hold of the pin, the slider is forced radially outward by the combination of the centrifugal force of the rotating grenade and an arming spring to a radial position at which the stab detonator (e.g. firing pin) carried in the grenade becomes aligned with the lead explosive charge. At that point in the flight, the grenade becomes fully armed, and the arming spring holds the slide in that fully armed position. On impact with the target or other mass, the stab detonator initiates the explosive train through contact with the lead charge at a high velocity. As stored for use, the tip end of the threaded firing pin engages the slider and prevents the slider from moving into position. Since the slider must be moved in order for the explosive to detonate, the grenade cannot be detonated, and, as stored, is safe.

An electromechanical self-destruct ("SD") mode is typically included in the existing grenade fuze as a back up. That includes a battery ampule, an electronic timer, and a capacitor. When the slider is forced radially outward, a spiral locking mechanism releases a battery activator, which ruptures an ampule of a reserve battery. During the movement of that activator, an electrical short-circuit is also removed so that the battery charges activates the electronic timer. After the lapse of a predetermined time, the capacitor discharges into the electro-explosive device next to the detonator, which causes the munition to function.

The foregoing prior art fuze occupies a significant portion of the package of the grenade and relies solely upon a series of mechanical operations to arm and ready the grenade for detonation. Should any of those mechanical operations fail to fully function as designed, the result is an unexploded grenade, a "dud".

The portion of the grenade volume not occupied by the fuze is filled with explosive. The greater the volume of explosive in the grenade, the greater the force that is produced on detonation. By reducing the volume of the fuze for a grenade of a given size, a more powerful grenade may be realized. However, the foregoing stab detonator type of fuze represents the smallest size for the fuze elements that has been demonstrated to date, and, presumably is the smallest size grenade fuze known to the art.

Accordingly, a principal object of the invention is to significantly reduce the physical volume (e.g. size) of the fuze used in submunitions.

A further object of the invention is to enhance the explosive power of existing submunitions.

An additional object of the invention is to miniaturize grenade fuzes.

A still further object of the invention is increasing the safety of submunitions for those who use the submunition.

Unintended operation and safety of an explosive is also of concern in fields outside of submunitions. Two devices used in those fields to ensure safety and avoid inadvertent operation are known, respectively, as a "arm-fire" device and a "safe and arm" device. In order to prevent a rocket motor, warhead, explosive separation device or energetic material, collectively sometimes referred to as target devices, from being unintentionally operated during flight or in any circumstance that could produce an extreme hazard to personnel or facilities, an arm-fire device is customarily incorporated in the firing control circuit of the foregoing devices. The arm-fire device electrically and mechanically interrupts the ignition train to the target device to prevent accidental operation.

The arm-fire device includes a mechanism that permits the target device to be armed, ready to fire, only while electrical power is being applied to the target device. When that electrical power is removed, the mechanism of the arm-fire device returns to a safe position, interrupting the path of the ignition train, signifying the target device is disarmed. Arm-fire devices typically use "through-bulkhead" initiators to transfer energy through a bulkhead from the arm-fire device on one side of the bulkhead to an acceptor device on the other side.

The safe and arm device is a variation of the arm-fire device. The mechanism of the safe and arm device enables a target device to remain armed, even after electrical power is removed. The device may be returned to a safe position only by again applying (or reapplying) electrical power. The safe and arm device is commonly used to initiate a system destruct in case of a test failure, for launch vehicle separation and for rocket motor stage separation during flight. Typically, the safe and arm device uses a pyrotechnic output (e.g. explosive train) which may be either a subsonic pressure wave or which may be a flame front and supersonic shock wave or detonation to transfer energy to another pyrotechnic device (and serves as the trigger of the latter device).

Although the latter two devices possess functions similar to that of the grenade fuze, the latter is entirely mechanical in operation. In contrast, the arm-fire device requires an electrical source to start and maintain operation and the safe and arm device must be armed by application of an electrical source and requires reapplication of an electrical source to disarm. Importantly, the latter devices have been the size of a person's fist and possess a noticeable weight of several pounds, rendering them impractical for application in the fuze of a submunition, and, particularly impractical for application in grenades. As an advantage, the present invention is able to apply those kinds of devices within a grenade fuze.

A recent innovation co-invented by a co-inventor of the present invention defines new structure for arm-fire devices and safe and arm devices in which the size and weight of the foregoing devices is dramatically reduced. Those small size devices benefit from the application of micro-electromechanical systems ("MEMS") technology. Reference is made to the copending U.S. patent application, Ser. No. 09/665,230, filed Sep. 18, 2000, entitled MEMS Arm Fire and Safe and Arm Devices, now U.S. Pat. No. 6,431,071 B1 assigned to the assignee of the present invention, the disclosure of which is incorporated herein by reference. The foregoing application describes a new design for both arm-fire devices and safe and arm devices in a microminature size. As an advantage, the fuze of the present invention incorporates the foregoing devices as a component.

Accordingly, a further object of the invention is to adapt MEMS arm-fire devices and safe and arm devices as a component of a fuze.

And a still further object of the invention is to provide an electrically operated fuze for submunitions, including grenades.

After a battle has been won, a remaining concern is clearing the battlefield of any unexploded submunitions, duds, so that one's troops and civilians may walk over the land without fear. The desire is to make the battlefield safe. Doing so is a difficult task, principally because of the difficulty of locating the dud. Even today, live shells from World War I continue to be uncovered from the battlefields of France, and some areas of land remain off-limits to this day. As an advantage, the present invention provides a fuze that may be destroyed by remote control.

A further object, thus, is to provide a more efficient and easy way to clear a battlefield of unexploded submunitions.

SUMMARY OF THE INVENTION

In accordance with the foregoing objects and advantages, the fuze invention includes a MEMS velocity sensor, a MEMS shock detector, a DC power supply and one of the MEMS arm-fire device or MEMS safe and arm device.

The velocity sensor, suitably a MEMS three-axis accelerometer, provides a signal when the grenade is at or above a predetermined velocity, which occurs only after the grenade is propelled from the grenade carrier safely distant from operational personnel. Responsive to that signal, the respective arm-fire device or safe and arm device is placed in an armed state. The MEMS shock detector, also suitably a MEMS three-axis accelerometer, supplies a signal when the grenade impacts a target. Responsive to that signal the respective arm-fire device or safe and arm device is fired, which initiates detonation of the high explosive charge carried in the grenade.

An additional feature of the invention comprises combining a pair of identical individual fuzes in a single package to provide a more reliable fuze for each submunition. Each fuze occupies a volume that is a small fraction of the volume of the prior grenade fuzes. The pair of those fuzes is also significantly less in volume and weight than the prior grenade fuzes. As an advantage, the foregoing fuze redundancy provides a fuze of greater reliability than the prior stab detonators of the prior art, reducing the likelihood of a dud. Should one of the two fuzes (or sub-fuzes) in the package fail, it is highly unlikely that the second in the pair would also fail.

As a still further feature to the invention, the fuze may include a RF receiver decoder. The output of the receiver decoder is coupled to the explosive initiator in fuze, whereby the broadcast of a coded broadcast signal results in detonation of the submunition. As an advantage, the invention eliminates the need to search for duds and the destruction of those submunitions is no more complicated than closing a switch.

The foregoing and additional objects and advantages of the invention, together with the structure characteristic thereof, which were only briefly summarized in the foregoing passages, will become more apparent to those skilled in the art upon reading the detailed description of a preferred embodiment of the invention, which follows in this specification, taken together with the illustrations thereof presented in the accompanying drawings.

DETAILED DESCRIPTION OF THE PREFERRED EMBODIMENTS

Figure 1:
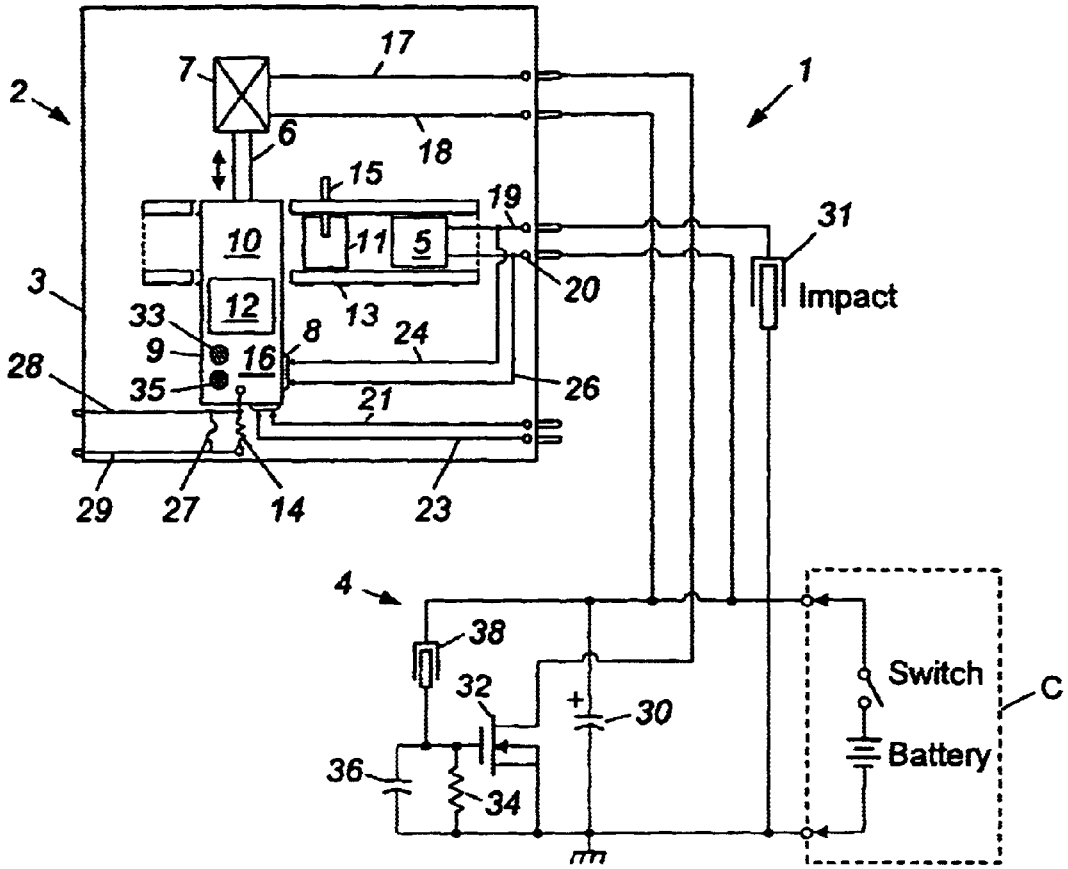
FIG. 1 illustrates an embodiment of the new fuze invention.

FIG. 1, to which reference is made, shows an embodiment of the present invention, illustrated in part pictorially and in part schematically, of an embodiment of a fuze 1 constructed in accordance with the invention. The fuze contains a MEMS arm-fire device 2, illustrated in the unarmed (safe) position in a not-to-scale pictorial top view and a velocity and impact sensing section 4, schematically illustrated.

Consider the arm-fire device 2 first. The arm-fire device includes a base 3, suitably of a conventional resin based printed circuit board, ceramic substrate or other substrate, and the various components attached to top and/or bottom surfaces of base 3. Those components of the MEMS arm-fire device include a MEMS ignition device 5, electromagnet or solenoid 7, and a multi-part mechanical slider assembly 9.

The slider assembly includes a movable slider 10, a firing piston 11, a firing piston channel 13 and a shear pin 15. Slider 10 is oriented perpendicular to the firing piston channel 13 for transverse movement. The slider contains an upper portion that is solid and serves as a barrier, a like bottom portion 16 and a passage or window 12 between the two cited portions, as later more fully described herein.

A tension spring 14 attaches to the remote end 16 of slider 10 and the armature 6 of solenoid 7 connects to the upper end of slider 10. Metal leads 17 and 18, plated on the base, electrically connect the terminals of electromagnet 7 to respective edge pins on an edge of the base 3. Likewise plated-on metal leads 19 and 20 electrically connect the terminals of the MEMS ignition device 5 to respective edge pins on the right edge of base 3.

Leads 24 and 26 are connected to leads 19 and 20 that in turn lead to the MEMS ignition device 5, and to respective contacts located on the side of the slider 10. The latter contacts are in contact with an electrical bridging contact 8 on the lower side of slider 10, when the slider is in the unarmed mode, as illustrated in the figure. As an added safeguard, the bridging contact places a short-circuit across the electrical circuit to MEMS ignition device 5 to prevent inadvertent electrical energization of that device.

Slider 10 is rectangular in cross section and sufficient in size to fill the lateral passages in the firing piston channel 13 but with sufficient clearance on the sides to move freely through that channel. If found necessary or desirable, guide rails may be included in the slider assembly 9 to guide slider 10 as it moves, assuring that the slider does not bind.

Slider 10 may be formed of a metal or a magnetic metal material. The central section of the slider assembly contains a passage or window 12 and another passage orthogonal thereto, not visible in the figure, that leads to the right and opens into channel 13. The window is bounded by four straight frame members, only two of which are visible in this top view, joining the upper portion of the slider to the lower section 16. The bottom surface of the slider underlying window 12 is closed by a panel, and the left vertical side of the slider adjacent window 12 is also closed by a panel, not illustrated.

On assembly of the device, the slider is pushed to the position illustrated with the upper barrier portion of slider 10 blocking firing channel 13. With the assistance of a microscope, the ends of spring 14 are hooked into holes, not illustrated, formed in the base 3 and in slider assembly 9, or may be soldered to those components.

The length of the upper portion of slider 10 is about equal to the distance to the front of solenoid 7 so that when the slider is moved through the firing channel 13 to, as example, into abutment with the solenoid or the uppermost position of travel, as later herein described during operation, the right hand side window, not visible in the figure, that is perpendicular to window 12, is centrally positioned in the firing piston channel 13, and provides a clear passage through that channel into the slider 10, and, through a right hand turn, (upwardly from the plane of the drawing) through window 12, the output for the channel.

Preferably, as a safety feature a fusible link 27 is mechanically coupled across spring 14, such as by soldering. Link 27 normally prevents the spring from expanding, and, hence, prevents slider 10 from changing in position at this stage, notwithstanding any shock or vibration as might occur during transport of the arm-fire device. Leads 28 and 29 extend the circuit from the link to contacts at the edge of base 3. The restraint of the link is removed at the appropriate time by applying current over those leads to fuse and break the link.

Velocity and impact section 4 includes a tantalum capacitor 30 that serves as a power supply for the entire fuze, a semiconductor switch 32, such as a MOSFET type transistor, and an R-C network, consisting of resistor 34 and capacitor 36 connected to the gate of transistor switch 32 and the source of the transistor switch (and circuit common). Additionally, section 4 includes a MEMS three-axis accelerometer 38 to sense velocity and a MEMS three-axis impact accelerometer 3l to sense impact. The impact accelerometer serves as the trigger section to the fuze to electrically trigger the MEMS explosive device 5 in the arm-fire device section. The foregoing components of the velocity and impact sensing section of the fuze may be fabricated on base 3 or on a separate substrate that may then be mounted on base 3.

The terminals of capacitor 30 connect to electrical contacts on the side of the grenade, not illustrated. Dash box C represents the carrier for the grenade. For this embodiment, the grenade carrier supplies electrical power from an internal supply, such as a battery, BAT, through the foregoing contacts to charge tantalum capacitor 30. The grenade carrier is designed to close an internal switch SW prior to launch of the grenade to complete the charging circuit to capacitor 30. Since the time from launch to the target is short, the capacitor is sufficient in capacity to supply the current to meet the low power requirements of the fuze. As those skilled in the art appreciate, a long life miniature chemical battery system, such as a launch activated zinc-air battery in combination with a DC boost converter, may be included, if one wishes to avoid the necessity of a charging circuit through the grenade carrier. A battery with a boost converter is also preferred in those embodiments in which additional electronic devices are added to the structure of the fuze, such as later herein described. Miniature zinc air batteries of the foregoing type are available. They possess an indefinite shelf life because they remain inactive until a plug covering the air hole is removed. Other batteries, such as the lithium ion type used in the modern pacemakers may also be used, but is less preferred.

Accelerometer 38 serves as a velocity sensor and is included as a safety measure. The accelerometer postpones arming of the fuze until the grenade attains a pre-set velocity following launch, thereby protecting operating personnel. The accelerometer is connected to resistor 34 and the positive polarity terminal of capacitor 30. The drain of transistor 32 is connected to one terminal of electromagnet 7 via lead 17, and the remaining end of that electromagnet connects to the positive polarity terminal of capacitor 30. However, the transistor cannot switch into the conductive state to supply energizing current to electromagnet 7 unless the transistor gate is biased positive, and electromagnet 7 remains deenergized. Since electromagnet 7 remains deenergized, the arm-fire device is not armed. Together, the accelerometer 38 and the switching transistor, thus, serve as a safety device.

Once the fuze is installed in the grenade and the grenade is in the field ready for possible use, personnel may apply external electrical current to the fusible link 27 via leads 28 and 29. Alternatively, the launching platform may contain appropriate probes to apply the external current to that fusible link when the grenade is inserted into the launching platform. That applied current melts the link, removing the restraint from spring 14 and slider 10. At this stage, the fuze remains in the safe mode and the grenade is ready for launch from the grenade carrier.

In safe mode, which FIG. 1 illustrates, solenoid 7 is deenergized, slider 10 is positioned blocking channel 13, and firing piston 11 is held in place by shear pin 15. Further, the electrical triggering circuit from the impact accelerometer 31 to MEMS ignition device 5 remains short circuited by the bridging contact at the side of the slider 10. The grenade is launched from the carrier C at which time the power supply BAT associated with the carrier charges capacitor 30.

Should the MEMS ignition device 5 be fired inadvertently while in safe mode, piston 11 is forced forward to break shear pin 15. However, the lateral force is not great enough to force slider 10 out of channel 13 or otherwise remove that barrier. In that circumstance the pyrotechnic blast cannot propagate through window 12. The side walls of the firing channel shown to the left in the figure adds further support to the side of the upper portion of slider 10, forming, so to speak, a buttress to prevent further lateral movement of the firing piston 11. The piston, hot gas and pressure remains confined and cannot reach a secondary igniter, not illustrated, external of the arm-fire device, located elsewhere inside the grenade; and the explosive charge carried in the grenade remains safe.

Once the grenade attains a preset velocity following launch, accelerometer 38 activates and closes the positive polarity terminal of capacitor 30 to the transistor gate, biasing transistor 32 to conduct current. The transistor switches to the current conducting state and energizes electromagnet 7 in the arm-fire section of the fuze. The electromagnet operates and the arm-fire circuit is armed and ready to be fired. The charge in capacitor 30 is sufficient to maintain the electromagnet operated for at least the anticipated duration of the flight of the grenade, which is of a relatively short duration. Further, the charge on capacitor 36 and the transistor gate maintains transistor 32 in conduction for the anticipated duration of the flight and for a short moment following impact.

Figure 2:
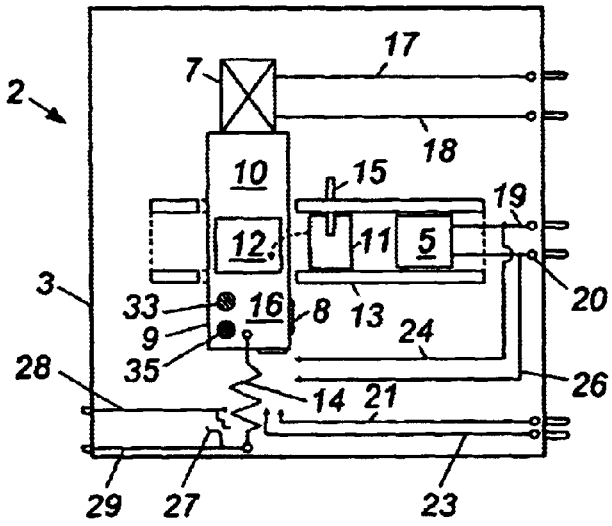
FIG. 2 is a partial illustration of the embodiment of FIG. 1, illustrating the MEMS arm-fire device component of the fuze in the fire position.

When velocity sensor accelerometer 38 has sensed the velocity level and transistor 32 is switched into the conductive state, the transistor conducts current from capacitor 30 through solenoid 7 via leads 17 and 18. The solenoid is energized and the arm-fire device is thereby placed into the "arm" mode, ready to be fired. The solenoid magnetically draws armature 6 within the coil of the solenoid, pulling slider 10, to which the armature is connected, toward the solenoid against the restraint of spring 14, which stretches and is placed in tension. As the slider 10 is drawn to solenoid 7, the barrier portion of the slider is moved out of channel 13, removing the blockage from the channel, such as is illustrated in FIG. 2 to which reference is made. When the slider reaches the uppermost position of travel, the arm-fire device is ready to fire.

As long as the solenoid 7 remains energized, the arm-fire device remains in the armed condition. Should the solenoid be de-energized, spring 14 pulls slider 10 back to the normal or safe position. The shear pin 15, another safety precaution, is strong enough to obstruct travel of the firing piston 11 when the latter is motivated only by vibration and/or acceleration, since the piston is thin, light weight, relatively flat and possesses insufficient moment of inertia.

When the grenade strikes the target, the impact is sensed by accelerometer 31 which then closes the electrical circuit from capacitor 30 to MEMS ignition device 5 through leads 19 and 20. Solenoid 7 is relatively slow to release so that the MEMS ignition device uses the remaining energy stored in capacitor 30 to ignite the explosive train.

Continuing with FIG. 2, MEMS ignition device 5 produces a "micro-burst" of hot gas and pressure that is directed against firing piston 11. Under the force exerted by the rapidly expanding hot gas and pressure wave, shear pin 15 breaks and firing piston 11 is propelled through channel 13 to the left, ultimately striking the side wall, not illustrated, to window 12 in slider 10. Pushed through the slider the piston is propelled by hot gases and pressure wave of the blast exit through window 12, perpendicular to the plane of the paper in FIG. 2, to initiate a larger explosive device, not illustrated, in the grenade, the secondary igniter, either directly or indirectly, and the grenade explodes.

The foregoing components may be fabricated to the requisite miniature size by any of the many available precision metal machine shops, particularly those firms having some experience with the MEMS technology or other miniaturized fabrication. The electromagnet 7 and firing piston channel 13, the latter supporting slider assembly 9, are attached to base 3, as example, with epoxy. MEMS ignition device 5 is also mounted at the end of the channel 13, through an end cutout in that channel to base 3, suitably by epoxy.

In a practical example, the base 3 of the foregoing embodiment is 2.5 cm by 2.5 cm square and 0.1 cm thick; and the entire unit weighs about 2 grams, which provides a 84% volume savings as compared to existing grenade fuzes that measuring 2.5 cm by 1.25 cm by 1.25 cm and 3.90 cc in volume. Compared to the "fist" sized safe and arm devices currently being used in much larger weapons than grenades, weighing approximately 900 grams, the arm and fire device of the present invention the savings in volume and weight is more dramatic. The new fuze is an improvement in weight alone of more than 99.9%, and a volume savings of about 99.99%. Commercial MEMS accelerometers, known to have been developed for the Department of Energy and rated for 2,000–200,000 g's, in a commercial package measures 0.028 cc (0.14 cm×0.71 cm×0.28 cm). The trigger section 4, including the accelerometers built on the back of base 3, adds about one square cm of volume and about one gram of additional weight to the foregoing components.

To test operation during assembly, as an additional feature the arm-fire device may include or be associated with indicator circuits. To serve that function a pair of contact pins mounted to base 3 connect via respective plated-on leads 21 and 23 to respective edge contacts on the base. The contact pins are positioned to contact a conductive metal end on slider 10, which serves as an electrical bridging contact when the slider is in the safe position illustrated in FIG. 1. Through the edge contacts on the base, the circuit through the foregoing contact pins connect to an indicator circuit, not illustrated, so that when the slider is in the safe position, the circuit through leads 21 and 23 is closed and an indicator, such as a lamp, will illuminate indicating "safe", to the operator. When the slider is moved, the circuit through leads 21 and 23 is broken to produce a signal for personnel.

Further, as a mechanical indicator, the slider 10 may be painted with green 33 and red 35 colored patches, only one of which may be viewed through an indicator window in the cover, not illustrated, to the arm-fire device. Normally the green patch is visible through a window in a cover, not illustrated, while the unit is in the safe mode. When the unit is placed in the arm mode, the red patch then becomes visible through the indicator window in lieu of the green patch. If a safe condition is not indicated for any reason, then personnel should investigate to determine the cause.

MEMS ignition device 5 is preferably constructed as described in U.S. Pat. No. 6,131,385 granted Oct. 17, 2000, entitled Integrated Pulsed Propulsion and Structural Support System for Microsatellite, assigned to an assignee of the present invention. In that structure a quantity of solid pyrotechnic material, such as lead styphenate or zirconium potassium perchlorate, is confined within millimeter (micro-miniature) sized cavity and the cavity is sealed by a wall. In other embodiments in which sub-sonic velocity of gas is desired, lead phtalate may be substituted. By design, that sealing wall is constructed to be weaker in strength than other walls in the cavity or contains a portion of that wall that is deliberately weakened. To complete the ignition unit, the cavity is mounted in thermal conductive relationship to an electrical resistance heater element associated therewith.

Figure 3:
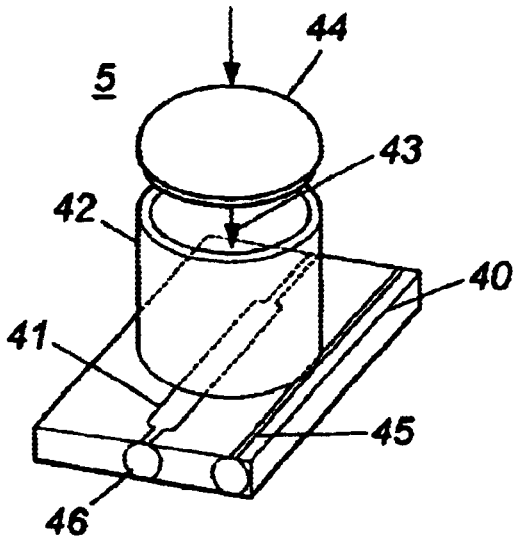
FIG. 3 illustrates a MEMS ignition device used in the embodiment of FIG. 1.

As illustrated in FIG. 3, a suitable MEMS pyrotechnic device 5 may be fabricated on a substrate 40, such as a circuit board, ceramic layer or other conventional substrate material. A thermal resistive material 41 is deposited on the substrate, a small pot or cavity 42, about 1/16th inch in diameter is attached by epoxy atop the resistive material, pyrotechnic ingredient 43 is inserted into the pot, and the weak-strength cover 44 is sealed in place closing the cavity. Electrical contacts 45 and 46 and the associated wiring on the circuit board or substrate permit electrical current to be applied to resistance heater 41. The foregoing pyrotechnic device may be positioned in the combination of FIG. 1, oriented so that the lid is in the channel facing the direction of firing piston 11.

The MEMS ignition device produces a pyrotechnic output, typically a subsonic pressure wave or supersonic detonation wave, occurring, typically over an extremely short time interval of less or equal to one thousand micro-seconds. A typical MEMS ignition device in size measures about 900 $\mu$m by 900 $\mu$m×1400 $\mu$m. When one desires the unit to provide a pyrotechnic output, electric current is applied to the heater. Within a millisecond or so, the heat generated couples into the cavity and ignites the confined pyrotechnic material, which instantaneously produces expanding hot gas and a shock wave sufficient in force to break through the weaker wall of the unit.

Figure 4:
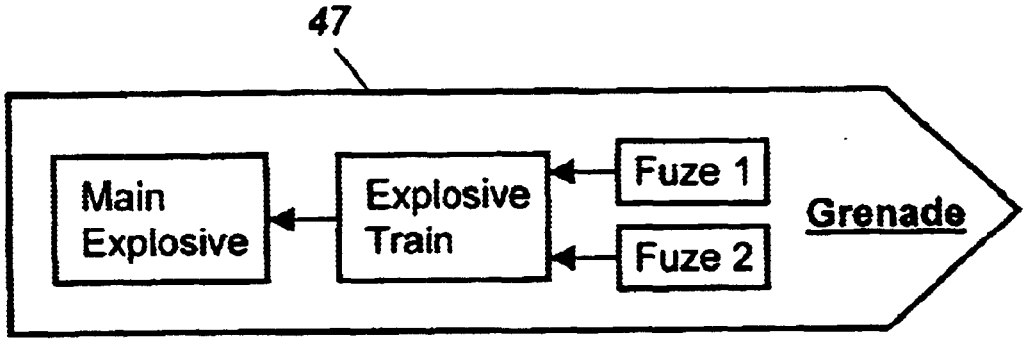
FIG. 4 is a diagram of a grenade that incorporates multiple fuzes of the type shown in FIG. 1 for enhanced reliability in grenade detonation.

For added reliability, two of the foregoing fuzes are preferably included in a grenade 47 to form a more reliable fuze, such as pictorially illustrated in FIG. 4. Both fuze 1 and fuze 2 in the grenade are arranged to supply their explosive output, earlier described, to a single explosive train or, as appropriate, directly to the main explosive. Typically, a smaller detonation is used to detonate a high explosive. Depending on characteristic of the explosive, it is often necessary to create a succession of explosions of increasing size in steps, referred to as an explosive train, in order to attain sufficient energy to detonate a particular explosive. In the foregoing grenade, either or both fuzes are capable of detonating the explosive train. Thus, if for any reason one of the fuzes fails, the other fuze will nonetheless initiate the explosive train to cause the main charge to explode. Because of the very small size of the described fuzes, it is now possible to place multiple fuzes within a given grenade to minimize, if not entirely eliminate, the possibility of a dud. The new fuze thus enhances the reliability of the sub-munition.

Figure 5:
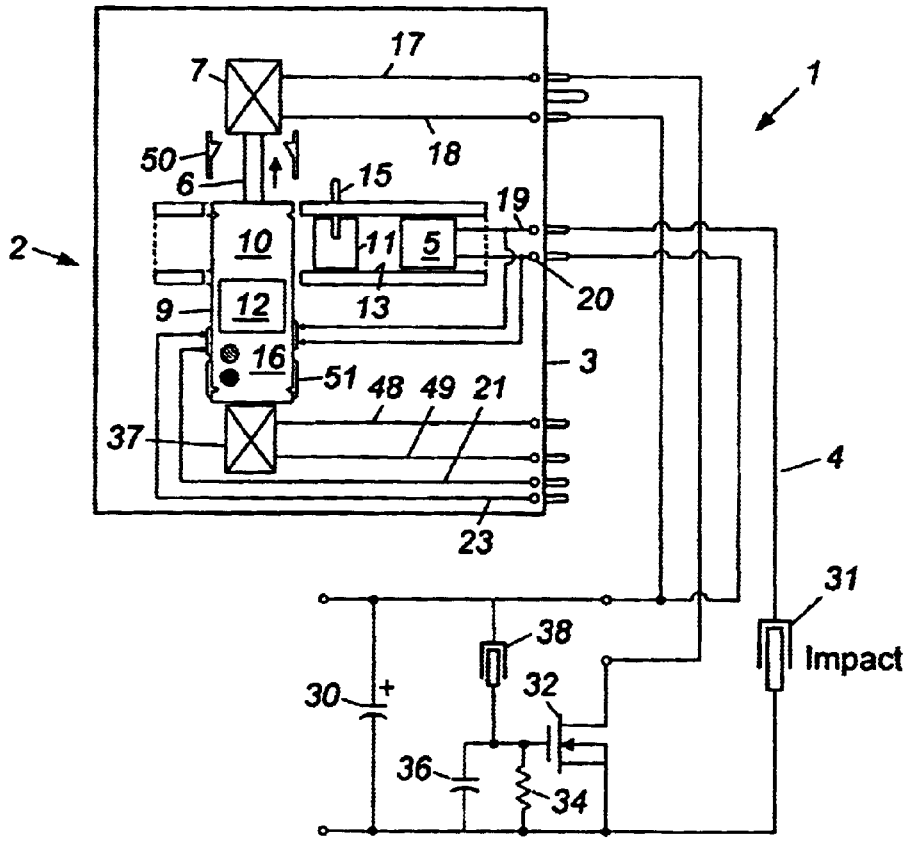
FIG. 5 illustrates a second embodiment of the invention.

Another embodiment of a fuze constructed in accordance with the invention is illustrated in FIG. 5 to which reference is made. To avoid unnecessary repetition and to facilitate understanding of the embodiment, the elements of this embodiment that have the same structure and function as a corresponding element of the prior embodiment are given the same numerical designation as the corresponding elements. Accordingly, a detailed description of those elements need not be repeated. Only those components added or the modifications to those components are given a new denomination.

This second embodiment employs a MEMS safe and arm device 2 and also employs a velocity and impact sensing section 4. As recalled, a safe and arm device is armed by application of electrical power, and remains armed even when the electrical power is subsequently withdrawn. The device is reset to the safe mode only by reapplication of power. As generally observed from FIGS. 5 and 6, the structure of the safe and arm device and velocity and impact sensing sections of the fuze employ many of the same components and functions that were included in the corresponding sections of the embodiment of FIGS. 1 and 2.

Consider first the safe and arm device. In addition to solenoid 7, a second like electromagnet or solenoid 37 is included, which is in lieu of the tension spring 14 used in FIG. 1. Leads 48 and 49 are included on base 3 to connect current to the solenoid 37, when the solenoid is to be operated. A pair of spring clip formed latches 50 and 51 are mounted to the base, one pair shown above slider 10 in the figure, and the other pair shown at the lower end gripping the end of the slider. The two latch members of latch 50 are located on each of the right and left sides of the path of movement of slider 10. Those of latch 51 are located at the right and left sides of the bottom end of the slider. The upper and lower ends of slider 10 are notched on each side to form the catches for the releasable latches. The latches are designed to spread outwardly and release their grip on slider 10 when a solenoid exerts a linear pull on the slider. However, the latches are strong enough to avoid opening under any foreseeable shock and vibration.

Figure 6:
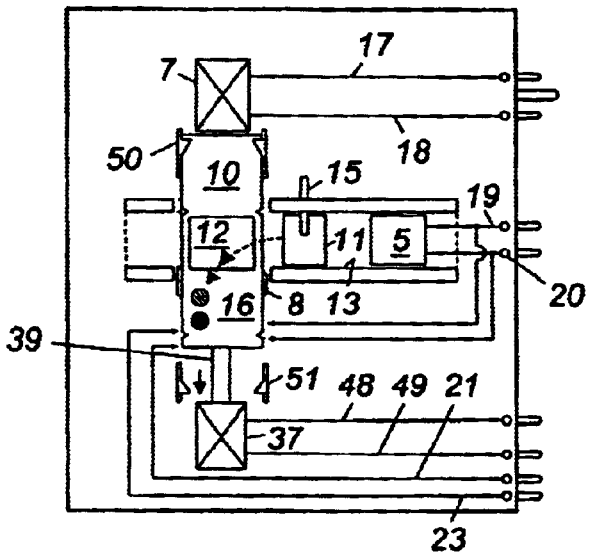
FIG. 6 is a partial illustration of the embodiment of FIG. 5, showing the MEMS safe-and-arm device component of the fuze in the fire position.

As in the prior embodiment, in the "safe" condition illustrated in FIG. 5, slider 10 blocks channel 13. Should MEMS ignition device 5 inadvertently fire, the hot expanding gases and the pressure wave produced in channel 13 is sufficient to break shear pin 15, which otherwise holds piston 11 stationary, and force firing piston 11 to the left. However the piston strikes the side of slider 10 and cannot move further to the left. Since window 12 in slider 10 is not aligned with channel 13, the piston and blast cannot pass through window 12 and initiate the explosive train. When current is applied to solenoid 7 (via leads 17 and 18), as occurs when accelerometer 38 in the trigger section has sensed a predetermined velocity to the grenade, solenoid 7 pulls in the armature 6, releases bottom latch 51, and pulls slider 10 more close to the uppermost position of travel, as shown in FIG. 6 to which reference is made.

Window 12 in slider 10 is thereby moved into place in firing channel 13, removing the barrier from the channel. As in the prior embodiment, the safe and arm device is ready to fire. When slider 10 is moved to solenoid 7, spring clips of latch 50 engage the notches in the side of the upper end of slider 10 and latch the slider (and the armature of solenoid 7) in place. When electrical current to solenoid 7 is later removed, latch 50 holds slider 10 in place. Hence, the slider remains in the armed position illustrated, ready to fire, although electrical power is withdrawn.

The arming and firing of the device is the same as in the prior embodiment, and need not be repeated in detail.

Briefly, accelerometer 38 senses the acceleration and momentarily closes its contacts when the grenade attains a specific level of velocity (e.g., the grenade is launched by the grenade carrier). That action in turn causes transistor 32 to switch into the conducting state. Current from the voltage source, the charged capacitor 30, passes through solenoid 7 and the transistor, which energizes the solenoid. Solenoid 7 operates and moves slider 10 into the armed position, earlier described in detail, producing the configuration of the safe and arm device illustrated in FIG. 2 in which window 12 is aligned in channel 13.

Resistor 34, in this embodiment, is of lower value than in the preceding embodiment, producing a smaller R-C time constant circuit that discharges capacitor 36 more quickly than before. Accordingly, the gate of transistor 32 remains positively biased for a short interval and the transistor remains in the conducting state only for that interval, since the transistor needs to remain in the conducting state only for the brief time required to latch solenoid 7. The impact detector, accelerometer 31, detects the impact of the grenade with a target. The accelerometer closes a circuit from the voltage source, capacitor 30, and through MEMS ignition device 5, triggering operation of the ignition device. The ignition device explodes, breaks shear pin 15, and pushes piston 11 through the channel, allowing the piston to propagate through the window to the explosive train, not illustrated, which results in the detonation of the high explosive contents of the grenade.

If, prior to launch, one wishes to halt the arm condition of the device and return the device to the safe mode, then current is applied to solenoid 37. The solenoid produces a magnetic field that pulls the solenoid armature 39 into the solenoid. Since armature 39 is attached to the lower end of slider 10, the slider is pulled back to the normal position illustrated in FIG. 5. The force produced by the solenoid is sufficient to overcome the restraining force of the latches 50. The spring clips of the latch are forced out of the notches as slider 10 is pulled toward solenoid 37. On completion, the safe and arm device is restored to the position shown in FIG. 5. For testing, leads 21 and 23 and a bridging contact on the side at slider 10 provide a circuit that may be coupled to an external indicator circuit as in the prior embodiment.

Following launch, it is not possible to return the safe and arm device in the foregoing fuze to the safe position. In alternative embodiments, later herein described, returning the safe and arm device in the fuze to the safe condition may be retained as an option.

By achieving the significant savings in volume of a fuze, not all of the volume saved need be used for packing additional explosive materials in the housing of the submunition. A part of that saved volume may be used to incorporate additional features into the fuze that is of benefit to the military. As example, although the described fuzes of FIGS. 1 and 5 may be employed in pairs within a submunition as should materially decrease the number of unexploded submunitions, duds might not be eliminated entirely. Unexploded submunitions are inherently unsafe. The submunitions could explode erratically or could explode if a soldier stumbles into one. To make the battlefield safe for one's soldiers as the territory is conquered, unexploded submunitions must be removed. The most convenient way to remove those duds is to find and explode them.

Figure 7:
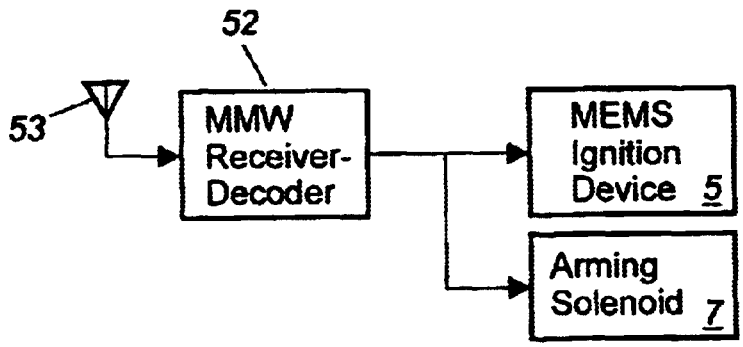
FIG. 7 is a block diagram of a fuze containing an RF receiver-decoder section as an alternate source of energization for the MEMS ignition devices in each of the embodiments of FIGS. 1 and 5.

In accordance with a further aspect to the invention, a miniature receiver-decoder is incorporated within the fuze as presented in the block diagram of FIG. 7 to which reference is made. Miniature RF receivers and decoder circuits are known that operate at millimeter-microwave ("MMW") frequencies. Such a MMW receiver decoder 52 may be included as part of the fuze. The antenna 53 is very short, perhaps less than one inch in length. The output of the receiver decoder is coupled to the ignition device 5 of the safe and arm device of the fuze embodiment of FIG. 5, and/or to the ignition device 5 and arming solenoid 7 in the arm-fire device of the fuze embodiment of FIG. 1. In either system, it is preferable to employ a battery, such as a lithium ion battery or zinc-air battery, and a DC converter combination as the power source for the fuze with the charged capacitor 30 used in those embodiments. The battery is able to supply a sustained amount of power, and, hence, is able to supply power for the MMW receiver decoder for a greater period.

With the foregoing fuze, personnel need to use a MMW transmitter to broadcast the appropriate code that is programmed in the MMW receiver decoder in the submunition. Detecting that code the receiver decoder initiates operation of the MEMS ignition device 5 in the fuze and/or the arming solenoid 7, depending on the structure of the particular fuze used in the submunition, and the submunition explodes. As recognized from the preceding description, the safe and arm device remains armed even after electrical power is withdrawn. Hence, one need only initiate the MEMS ignition device 5 to explode the submunition. The arm-fire device does not remain armed. Hence, in those embodiments it is necessary to power solenoid 7 to arm the fuze as well as triggering the MEMS ignition device 5. No time is devoted to searching for and locating the unexploded submunition. In the foregoing way, the battlefield may be quickly rendered safe. As an addition or alternative, a like receiver-decoder may be included in the embodiment of FIG. 5 to energize relay 37 on receipt of a broadcast code and thereby return the safe and arm device to the safe mode.

Figure 8:
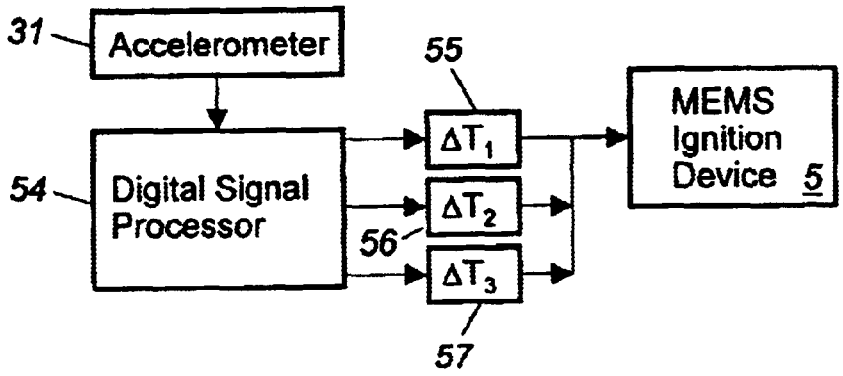
FIG. 8 illustrates another embodiment of the invention that contains a programmed microprocessor for tailoring the time of detonation to the physical characteristic of the target impacted by the submunition, a "smart" fuze.

In an additional embodiment, the foregoing fuze structure is rendered "smart". That is, the fuze is able to discern the physical characteristic of the target and detonate the explosive in the submunition at a point in time as achieves the maximum desired effect on that particular target. Reference is made to FIG. 8, which illustrates such an embodiment. The foregoing fuze structures of FIGS. 1 and 5 are modified to include a digital signal processor 54, a semiconductor microprocessor, in circuit between the impact sensing accelerometer 31 and the MEMS ignition device 5 of the fuze.

Accelerometer 31 can be made to produce an output signal that indicates the amount of shock on impact with an object, referred to generally as the target. That impact is most intense if the submunition strikes a hard object such as steel, and less intense if a soft object, such as the branches of a tree is struck. Processor 54 monitors the output of the accelerometer. In accordance with an internal program, firmware, the processor processes that information and determines the type of target that is being struck by the submunition. The processor consults the program to determine the optimal time delay to use before detonation, represented in the figure as three different time delays, 55, 56 and 57 for possible selection. After making that selection, the processor outputs through the particular time delay to the MEMS ignition device of the fuze.

It should be recognized that the time delays are represented in the figure as external hardware circuits for purposes of illustration. The preferred manner is to employ a delay routine in the stored program of the processor. As example, if a particular delay is required, a counter may be loaded with a particular count. The processor decrements the counter periodically until the counter decrements to zero and initiates an output or flag. On finding that output or flag during a periodic check the program requires the processor to output to the MEMS ignition device 5 of the fuze.

The foregoing occurs and is completed in under one-half second. As example, upon impact with the target, high-speed target discrimination begins where the firmware of the processor classifies the target as hard, soft or void using both deceleration and impact time and initiates the time delayed warhead detonation. The time delay for hard, soft and void targets is 50–700 μsec, 30–70 msec and 8–12 msec, respectively. Finally, impact results in either detonation/target kill or, as a possible alternative, the power supply discharges rendering the unexploded round inert.

Existing processor chips are capable of acting quickly enough. Mid-range DSP chips average 100 MHz operating speed with high-end DSP chips reaching up to 300 MHz. One potential DSP is the TMS320C67. It is rated for 100–167 MHz with a 32-bit and 64-bit IEEE-754 floating-point DSP (digital signal processor) with VLIW (very large instruction word), load/store architecture; thirty-two 32-bit registers; very deep pipeline; two multipliers, ALUs (arithmetic & logic units), and shifters; and cache. Such a 100 MHz chip allows for 10,000 clock cycles in 100 microseconds. The foregoing provides some margin of time, since some clock cycles allow multiple processor steps to occur. The processing speed is somewhat degraded by the required input-output ("I/O") functions and overhead of the processor. However, the processing content in the foregoing time window appears substantial. In the case of the impact damage, for a 600 ft/sec projectile at impact, in 100 microseconds there is about ¾ inch of projectile collapse. The foregoing window allows ample time for processing before the impact front reaches the fuze body. While upon impact the shock wave travels hypersonically through the projectile, the energy spike of that shock wave is expended at the tail end of the projectile.

Figures 1, 10:
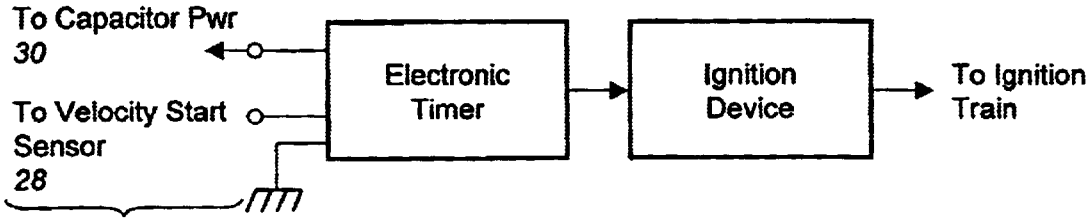
FIG. 10 illustrates an accessory electronic self-destruction device as an additional feature that may be added to the embodiment of FIG. 1 and other embodiments.

As an additional feature, the foregoing embodiments may also incorporate an electronic self-destruction device akin in structure and function to that found in the prior fuzes. Such feature incorporates a miniature semiconductor device that functions as an electronic timer and an additional ignition device, which is also connected to the ignition train of the grenade. When the grenade is launched and the preset velocity attained, velocity sensor 38 would also connect the timer to the voltage supply, capacitor 30, which initiates the time-out period as well as connects a locking circuit to maintain connection to the voltage supply even if sensor 38 no longer functions. The time-out period is an interval that is well in excess of the anticipated time of flight of the grenade. Should the fuze fail to operate on impact as described, then, later, on completion of the time-out period the electronic timer initiates the energization of the additional ignition device. In that way, grenades that remain in a dangerous state on the battlefield may be rendered harmless when they are no longer serve a purpose. Such an accessory self-destruction device is illustrated in FIG. 10 and may be considered together with the fuse of FIG. 1. Capacitor 30 (FIG. 1) provides the voltage to power electronic timer 70 and velocity sensor 38 provides the trigger signal to the start input of that timer. Electronic timer 70 outputs to ignition device 71 on expiration of the set time. The ignition device outputs to the same ignition train as the arm fire device 2 in FIG. 1.

Figure 9:
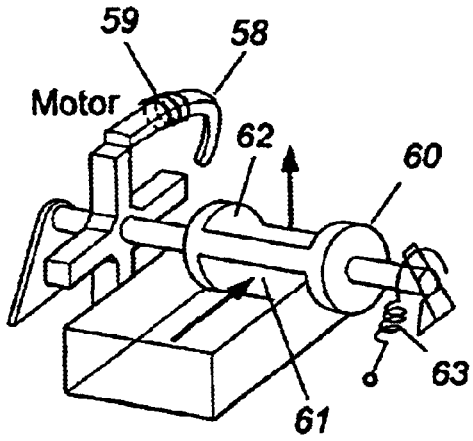
FIG. 9 illustrates an alternative construction for the slider component of the arm-fire device used in the fuze embodiment of FIG. 1.

The foregoing embodiment of FIG. 1 employed a slide type of arming device. The function served by slider assembly 9 in the arm-fire device is not limited to sliders and may alternatively be served by other electro-mechanically-operated structures. One example is a rotary type device, such as the device pictorially illustrated in FIG. 9 to which references is made. In this a motor mechanism 58, containing electromagnetic coil 59, turns the shaft of a cylindrical valve 60 by ninety degrees against the restraint of a spring when electromagnet coil 59 is energized with DC current. The side of the cylinder contains two openings 61 and 62 that are spaced ninety degrees apart about the cylindrical axis. The cylinder also contains an internal passage between those openings. In application, when the motor winding is energized the shaft turns by ninety degrees, to orient the two passages one way. When the winding is deenergized, the magnetic pull of the winding collapses and spring 63 turns the shaft in the reverse directing reorienting the passages in cylinder 60 to the normal position. As placed into the device, as example, of FIG. 1, the orientation in the normal position normally prevents gas from passing through the cylinder when the motor winding is not energized.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus, the invention is to be broadly construed within the full scope of the appended claims.

What is claimed is:

1. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target;

said miniature arming device including:

a miniature ignition device for producing a pyrotechnic output at a first location in response to application of an electric signal and a pyrotechnic output control means, said pyrotechnic output control means having an armed state and an unarmed state for routing said pyrotechnic output from said first location to a second location when in said armed state and blocking said pyrotechnic output from said second location when in said unarmed state;

a source of voltage; and a substrate, said substrate supporting said miniature ignition device, said pyrotechnic output control means, said triggering device, said safety device and said source of voltage.

2. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target, said safety device comprising a velocity sensor for placing a pyrotechnic output control means in an armed state in response to detection of a predetermined velocity level;

said miniature arming device including:

a miniature ignition device for producing a pyrotechnic output at a first location in response to application of an electric signal;

said pyrotechnic output control means, having an armed state and an unarmed state, for routing said pyrotechnic output from said first location to a second location when in said armed state and blocking said pyrotechnic output from said second location when in said unarmed state;

a substrate, said substrate supporting said miniature ignition device and said pyrotechnic output control means;

a source of voltage; and said safety device further comprising:

a semiconductor switch, said semiconductor switch including a control terminal and an output terminal, said output terminal for conducting current to place said pyrotechnic output control means in said armed state only when said control terminal is biased to a predetermined voltage level;

said velocity sensor being connected in circuit between said source of voltage and said control terminal for applying a voltage of said predetermined voltage level to said control terminal on detection of a predetermined velocity level.

3. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target;

said miniature arming device including:

a miniature ignition device for producing a pyrotechnic output at a first location in response to application of an electric signal;

pyrotechnic output control means, having an armed state and an unarmed state, for routing said pyrotechnic output from said first location to a second location when in said armed state and blocking said pyrotechnic output from said second location when in said unarmed state;

a substrate, said substrate supporting said miniature ignition device and said pyrotechnic output control means; and a source of voltage;

said triggering device comprising a shock detector for providing a signal to said miniature ignition device responsive to detection of a predetermined level of shock, said shock detector including:

a three-axis accelerometer for sensing a predetermined level of shock, said three-axis accelerometer being adapted to close a circuit in response to a predetermined level of shock.

4. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target, said safety device comprising a velocity sensor for placing a pyrotechnic output control means in an armed state in response to detection of a predetermined velocity level;

said miniature arming device including:

a miniature ignition device for producing a pyrotechnic output at a first location in response to application of an electric signal;

said pyrotechnic output control means, having an armed state and an unarmed state, for routing said pyrotechnic output from said first location to a second location when in said armed state and blocking said pyrotechnic output from said second location when in said unarmed state;

a substrate, said substrate supporting said miniature ignition device and said pyrotechnic output control means; and a source of voltage;

said velocity sensor comprising:

a three-axis accelerometer for sensing velocity, said three-axis accelerometer being adapted to close a circuit in response to said submunition traveling at and above a predetermined velocity.

5. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target;

said miniature arming device including:

a miniature ignition device for producing a pyrotechnic output at a first location in response to application of an electric signal;

pyrotechnic output control means, having an armed state and an unarmed state, for routing said pyrotechnic output from said first location to a second location when in said armed state and blocking said pyrotechnic output from said second location when in said unarmed state;

a substrate, said substrate supporting said miniature ignition device and said pyrotechnic output control means; and a source of voltage;

said triggering device including: an impact sensor for producing a signal representative of the intensity of impact; and a programmed microprocessor for interpreting said signal from said impact sensor and producing an output at a selected time interval following said impact, said selected time interval being selected by said programmed microprocessor based on said interpretation of said signal from said impact sensor.

6. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target;

said miniature arming device including:

a miniature ignition device for producing a pyrotechnic output at a first location in response to application of an electric signal:

pyrotechnic output control means, having an armed state and an unarmed slate, for routing said pyrotechnic output from said first location to a second location when in said armed state and blocking said pyrotechnic output from said second location when in said unarmed state;

a substrate, said substrate supporting said miniature ignition device and said pyrotechnic output control means;

a source of voltage; and a millimeter microwave receiver and decoder, said millimeter microwave receiver and decoder for detonating said miniature ignition device in response to reception of a coded millimeter microwave signal from a remote source.

7. A fuze for a submunition, said fuze adapted to be carried by said submunition and control detonation of said submunition, comprising:

a triggering device for determining impact of said submunition with a target and supplying a signal indicative of said impact;

a miniature arming device, said miniature arming device including an armed state and an unarmed state for initiating detonation of said submunition on receipt of said signal from said triggering device only when in said armed state; and a safety device for placing said miniature arming device in said armed state when said submunition is en route to a target, said safety device comprising a velocity sensor for placing a pyrotechnic output control means in an armed state in response to detection of a predetermined velocity level;

said miniature arming device including:

a miniature ignition device for producing a pyrotechnic output at a first location in response to application of an electric signal;

said pyrotechnic output control means, having an armed state and an unarmed state, for routing said pyrotechnic output from said first location to a second location when in said armed stats and blocking said pyrotechnic output from said second location when in said unarmed state;

a substrate, said substrate supporting said miniature ignition device and said pyrotechnic output control means;

a source of voltage; and an electronic timer and a second ignition device, said electronic timer being preset to produce an output for firing said second ignition device on the lapse of a predetermined interval following energization; said electronic timer being energized from said voltage source when said velocity sensor detects a predetermined velocity level.

8. The fuze for a submunition as defined in claim 7, further comprising: a millimeter microwave receiver and decoder, said millimeter microwave receiver and decoder for detonating said miniature ignition device in response to reception of a coded millimeter microwave signal from a remote source.

* * * * *